US008070524B2

(12) United States Patent
Gencarelli

(10) Patent No.: US 8,070,524 B2
(45) Date of Patent: Dec. 6, 2011

(54) ELECTRIC PLUG DEVICE FOR EXTENDING AND REPLACING A MALFUNCTIONING FEMALE POWER OUTLET

(76) Inventor: Angelo Gencarelli, Nutley, NJ (US)

( * ) Notice: Subject to any disclaimer, the term of this patent is extended or adjusted under 35 U.S.C. 154(b) by 0 days.

(21) Appl. No.: 12/269,038

(22) Filed: Nov. 12, 2008

(65) Prior Publication Data

US 2011/0039453 A1 Feb. 17, 2011

(51) Int. Cl.
*H01R 25/00* (2006.01)

(52) U.S. Cl. ..... 439/652; 439/131

(58) Field of Classification Search ..... 439/131, 439/652, 535

See application file for complete search history.

(56) References Cited

U.S. PATENT DOCUMENTS 5,700,150 A * 12/1997 Morin ..... 439/652
5,780,775 A 7/1998 Yu
5,895,275 A * 4/1999 Harbertson ..... 439/21
6,024,604 A * 2/2000 Chilton et al. ..... 439/579
6,229,691 B1 * 5/2001 Tanzer et al. ..... 361/622
6,642,450 B1 * 11/2003 Hsiao ..... 439/650
7,396,234 B2 * 7/2008 Sun ..... 439/131
7,517,221 B2 * 4/2009 Chidakel et al. ..... 439/32
2007/0123108 A1 5/2007 Ivanova et al.

* cited by examiner

*Primary Examiner* — Briggitte R Hammond
(74) *Attorney, Agent, or Firm* — Ash Tankha; Lipton, Weinberger & Husick

(57) ABSTRACT

An electric plug device and a method for extending and replacing a malfunctioning female power outlet are provided. The electric plug device comprises a mains plug, an extension cable, and a power extender. The mains plug comprises a male power inlet and multiple first female power outlets. The male power inlet is electrically connected to the first female power outlets and provides an electrical input pathway. The first female power outlets provide electrical output pathways. The malfunctioning female power outlet may be one of the first female power outlets. The extension cable electrically connects the malfunctioning female power outlet to the power extender. The power extender comprises multiple second female power outlets. The malfunctioning female power outlet is connected to the second female power outlets by the extension cable. The extension cable and the power extender enable the extension and the replacement of the malfunctioning female power outlet respectively.

19 Claims, 4 Drawing Sheets

ELECTRIC PLUG DEVICE FOR EXTENDING AND REPLACING A MALFUNCTIONING FEMALE POWER OUTLET

BACKGROUND

This invention, in general, relates to electric plugs. More particularly, this invention relates to an electric plug device for extending and replacing a malfunctioning female power outlet.

An electric plug typically comprises multiple female power outlets for plugging in multiple electrical devices. If one of the multiple female power outlets malfunctions or is unusable, connecting electrical devices to the malfunctioning female power outlets may be problematic or impractical. It may also be difficult for the user to replace the malfunctioning female power outlets. The replacement may also be laborious and may require a technician. Moreover, the malfunctioning female power outlet requires replacement with a new power outlet which may be expensive.

Furthermore, a single electric plug may only have a limited number of female power outlets for connecting electrical devices. There is a need for an electric plug device that may extend the number of female per outlets for connecting multiple electrical devices.

Hence, there is an unmet need for an electric plug device and method that extends and replaces a malfunctioning female power outlet.

SUMMARY OF THE INVENTION

This summary is provided to introduce a selection of concepts in a simplified form that are further described in the detailed description of the invention. This summary is not intended to identify key or essential inventive concepts of the claimed subject matter, nor is it intended for determining the scope of the claimed subject matter.

The method disclosed herein addresses the above stated need for extending and replacing a malfunctioning female power outlet. An electric plug device comprising a mains plug and a power extender is provided. The mains plug comprises a male power inlet and multiple first female power outlets. The male power inlet and the first female power outlets of the mains plug are embedded in a first insulating case. The male power inlet provides an electrical input pathway. The male power inlet is electrically connected to the first female power outlets within the first insulating case. The first female power outlets provide multiple electrical output pathways.

The power extender comprises multiple second female power outlets for providing multiple electrical output pathways. The second female power outlets of the power extender are embedded in a second insulating case. An extension cable is provided. The extension cable comprises a first end and a second end. The first end of the extension cable is electrically connected to the malfunctioning female power outlet. The second end of the extension cable is electrically connected to the second female power outlets of the power extender. The electrical connection enables flow of electric current from the first female power outlets to the second female power outlets. The malfunctioning female power outlet is therefore replaced by the power extender comprising the second female power outlets.

BRIEF DESCRIPTION OF THE DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and instrumentalities disclosed herein.

DETAILED DESCRIPTION OF THE INVENTION

Figure 1:
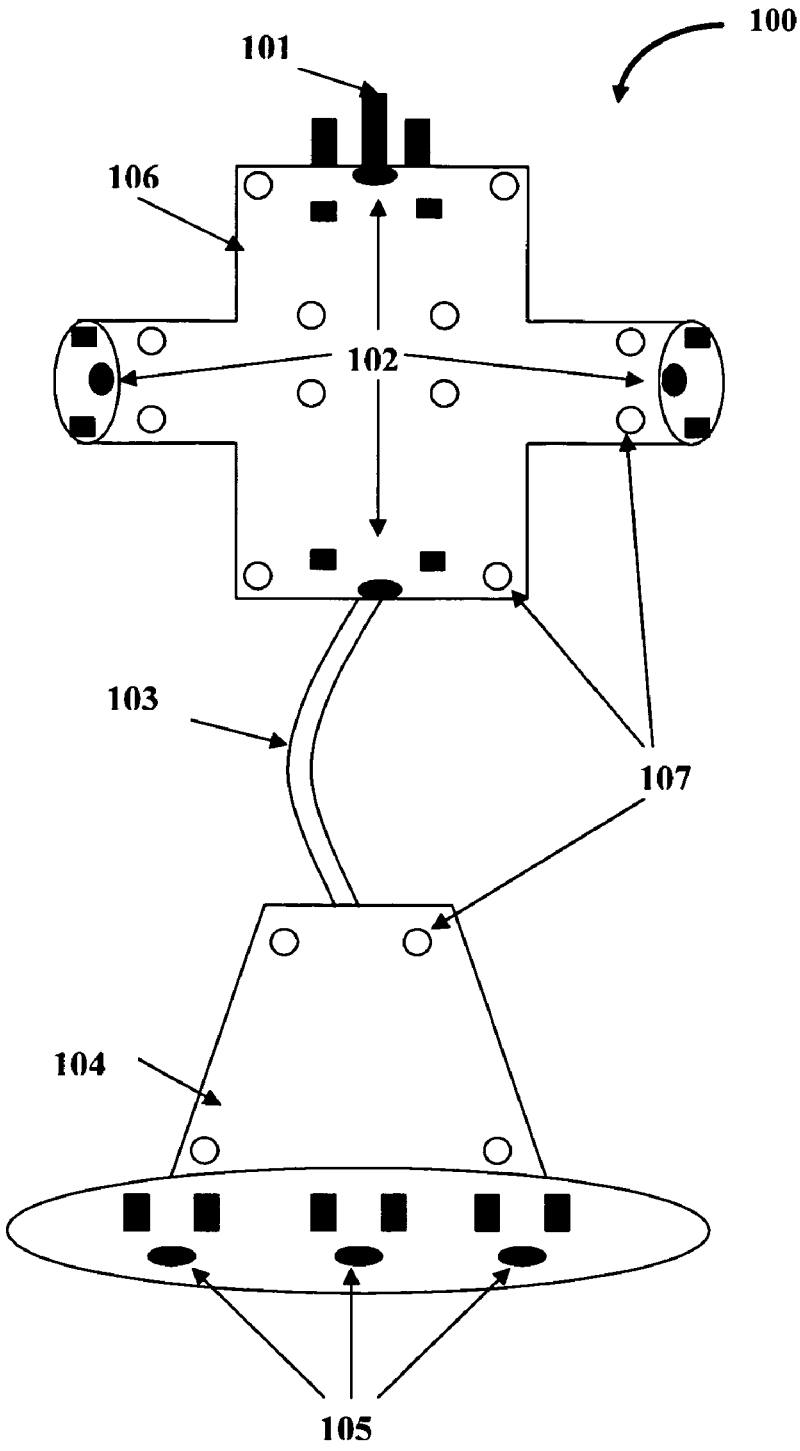
FIG. 1 exemplarily illustrates an electric plug device for extending and replacing a malfunctioning female power outlet.

FIG. 1 illustrates an electric plug device 100 for extending and replacing a malfunctioning female power outlet 102*a*, 102*b*, 102*c*, or 102*d*. The malfunctioning female power outlet may, for example, be 102*a*, 102*b*, 102*c*, or 102*d*. The electric plug device 100 comprises a mains plug 200, an extension cable 103, and a power extender 300. The mains plug 200 comprises a male power inlet 101 and two or more first female power outlets, for example, 102*a*, 102*b*, 102*c*, and 102*d*. The mains plug 200 further comprises a first insulating case 106 for embedding the male power inlet 101 and the first female power outlets 102*a*, 102*b*, 102*c*, and 102*d* as exemplarily illustrated in FIG. 1 and FIG. 2.

Figure 2:
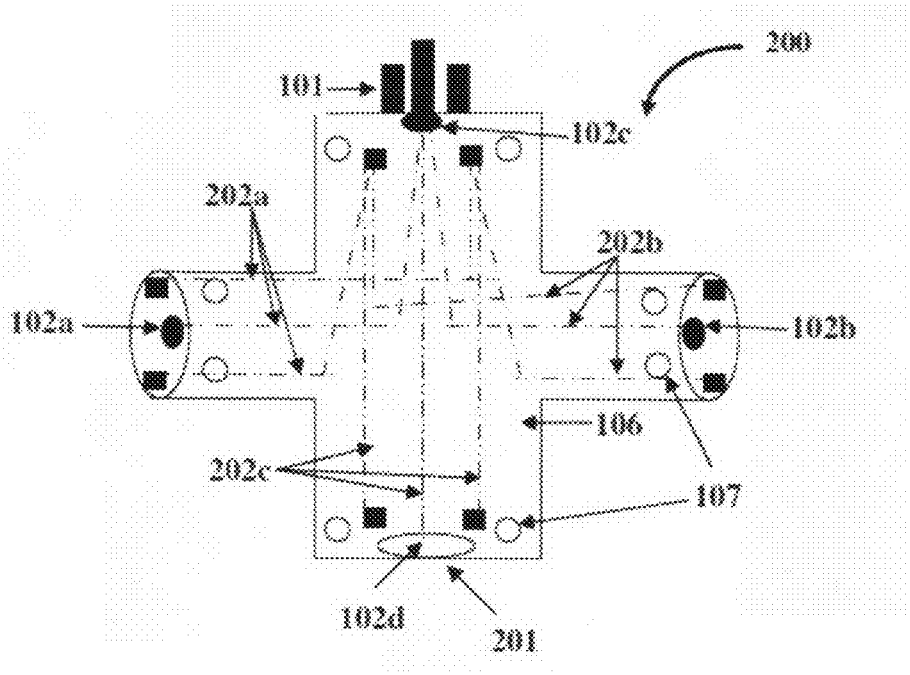
FIG. 2 exemplarily illustrates a mains plug comprising a first insulating case embedded with a male power inlet and first female power outlets.

The male power inlet 101 provides an electrical input pathway and comprises pins or blades that connect mechanically or electrically to openings in an external power outlet. The male power inlet 101 is electrically connected to the first female power outlets 102*a*, 102*b*, 102*c*, and 102*d* as illustrated in FIG. 1 and FIG. 2. The mains plug 200 may, for example, be used to repair one or more existing malfunctioning female power outlets (not shown). The first female power outlets 102*a*, 102*b*, 102*c*, and 102*d* provide electrical output pathways. The first female power outlets 102*a*, 102*b*, 102*c*, and 102*d* comprise openings or slots and accept pins or blades of an electric device. The first female power outlets 102*a*, 102*b*, 102*c*, and 102*d* are female electrical connectors. The electric plug device 100 is therefore a male electrical connector with integrated female electrical connectors.

The electric plug device 100 may, for example, have a voltage rating of 110 volts. The voltage rating may be increased to 220 volts by replacing the male power inlet 101 and the first female power outlets 102*a*, 102*b*, 102*c*, and 102*d* with another male power inlet and power outlets respectively based on predefined electrical codes. The electric plug device 100 may be plugged into an external power outlet.

In FIG. 2, first internal wires 202*a*, 202*b*, and 202*c* used as the electrical connections between the male power inlet 101 and the first female power outlets 102*a*, 102*b*, 102*c*, and 102*d* are exemplarily indicated by dashed lines. The first internal wires 202*a*, 202*b*, and 202*c* provide a ground contact and a live contact for the male power inlet 101 and the first female power outlets 102*a*, 102*b*, 102*c*, and 102*d*. The male power inlet 101 and the first female power outlets 102*a*, 102*b*, 102*c*, and 102*d* are embedded in the first insulating case 106. The first insulating case 106 is provisioned for connecting the first end 103*a* of the extension cable 103 to a malfunctioning female power outlet 102*a*, 102*b*, 102*c*, or 102*d* through a first wire inlet 201 as illustrated in FIG. 2. The malfunctioning female power outlet may be one of the first female power outlets 102*a*, 102*b*, 102*c*, and 102*d*.

Multiple screws 107 may be provided for opening and closing the first insulting case 106 to connect the first end 103*a* of the extension cable 103 to the malfunctioning female power outlet 102*a*, 102*b*, 102*c*, or 102*d* through the first wire inlet 201. The first insulating case 106 may, for example, be in the shape of a cross with the first female power outlets 102*a*, 102*b*, 102*c*, and 102*d* present at the four corners of the cross shaped first insulating case 106 as illustrated in FIG. 2. The first insulating case 106 is made of a material that resists electric current flow and provides protection from electric shock hazards. The material may, for example, be plastic, ceramic, glass, etc.

Figure 3:
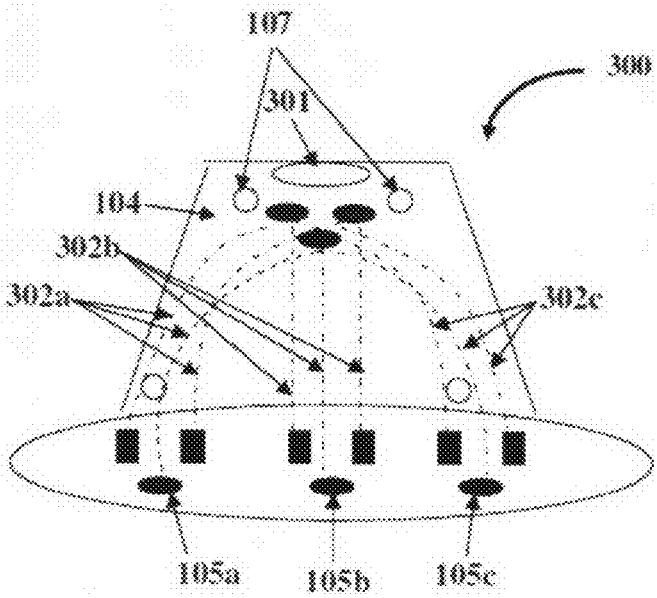
FIG. 3 exemplarily illustrates a power extender comprising a second insulating case embedded with second female power outlets.

FIG. 3 exemplarily illustrates a power extender 300 comprising a second insulating case 104 embedded with second female power outlets 105*a*, 105*b*, and 105*c*. The power extender 300 may, for example, be used to repair an existing extension cord or make an extension cord with multiple second female power outlets 105*a*, 105*b*, and 105*c*. For purposes of illustration, the detailed description refers to a single extension cable 103 and a single malfunctioning female power outlet 102*a*, 102*b*, 102*c*, or 102*d*; however the scope of the electric plug device 100 and method disclosed herein is not limited to a single extension cable 103 and a single malfunctioning female power outlet 102*a*, 102*b*, 102*c*, or 102*d* but may be extended to include multiple extension cables and multiple malfunctioning female power outlets.

The extension cable 103 is a flexible electric cable. The extension cable 103 comprises a first end 103*a* and a second end 103*b*. The extension cable 103 is unrolled in length and the first end 103*a* of the extension cable 103 is connected to the malfunctioning female power outlet 102*a*, 102*b*, 102*c*, or 102*d* through a first wire inlet 201. The second end 103*b* of the extension cable 103 is electrically connected to the power extender 300 through a second wire inlet 301. The power extender 300 comprises multiple second female power outlets 105*a*, 105*b*, and 105*c*. The second female power outlets 105*a*, 105*b*, and 105*c* comprise openings or slots and accept pins or blades from external electrical appliances. The second end 103*b* of the extension cable 103 connected to the power extender 300 allows replacement of the malfunctioning female power outlet 102*a*, 102*b*, 102*c*, or 102*d* by the second female power outlets 105*a*, 105*b*, and 105*c*.

The second female power outlets 105*a*, 105*b*, and 105*c* are embedded in the second insulating case 104. The second insulating case 104 is provisioned for connecting the second end 103*b* of the extension cable 103 to the second female power outlets 105*a*, 105*b*, and 105*c* through a second wire inlet 301. Multiple screws 107 are provided for opening and closing the second insulting case 104 to connect the second end 103*b* of the extension cable 103 to the second female power outlets 105*a*, 105*b*, and 105*c* through a second wire inlet 301. The second insulating case 104 may, for example, be in the shape of a cone with the second female power outlets 105*a*, 105*b*, and 105*c* present at the base of the cone as illustrated in FIG. 3. The second insulating case 104 is made of a material that resists electric current flow and provides protection from electric shock hazards. The material may, for example, be plastic, ceramic, glass, etc.

Second internal wires 302*a*, 302*b*, and 302*c* electrically connect the second end 103*b* of the extension cable 103 to the second female power outlets 105*a*, 105*b*, and 105*c*. In FIG. 3, the second internal wires 302*a*, 302*b*, and 302*c* used as the electrical connections between the second female power outlets 105*a*, 105*b*, and 105*c* are exemplarily indicated by dashed lines. The second internal wires 302*a*, 302*b*, and 302*c* provide a ground contact and a live contact for the male power inlet 101, the extension cable 103, and the second female power outlets 105*a*, 105*b*, and 105*c*. Multiple third female power outlets (not shown) may be laterally positioned on the mains plug 200 and the power extender 300 of the electric plug device 100. The third female power outlets provide additional electrical output pathways.

Figure 5:
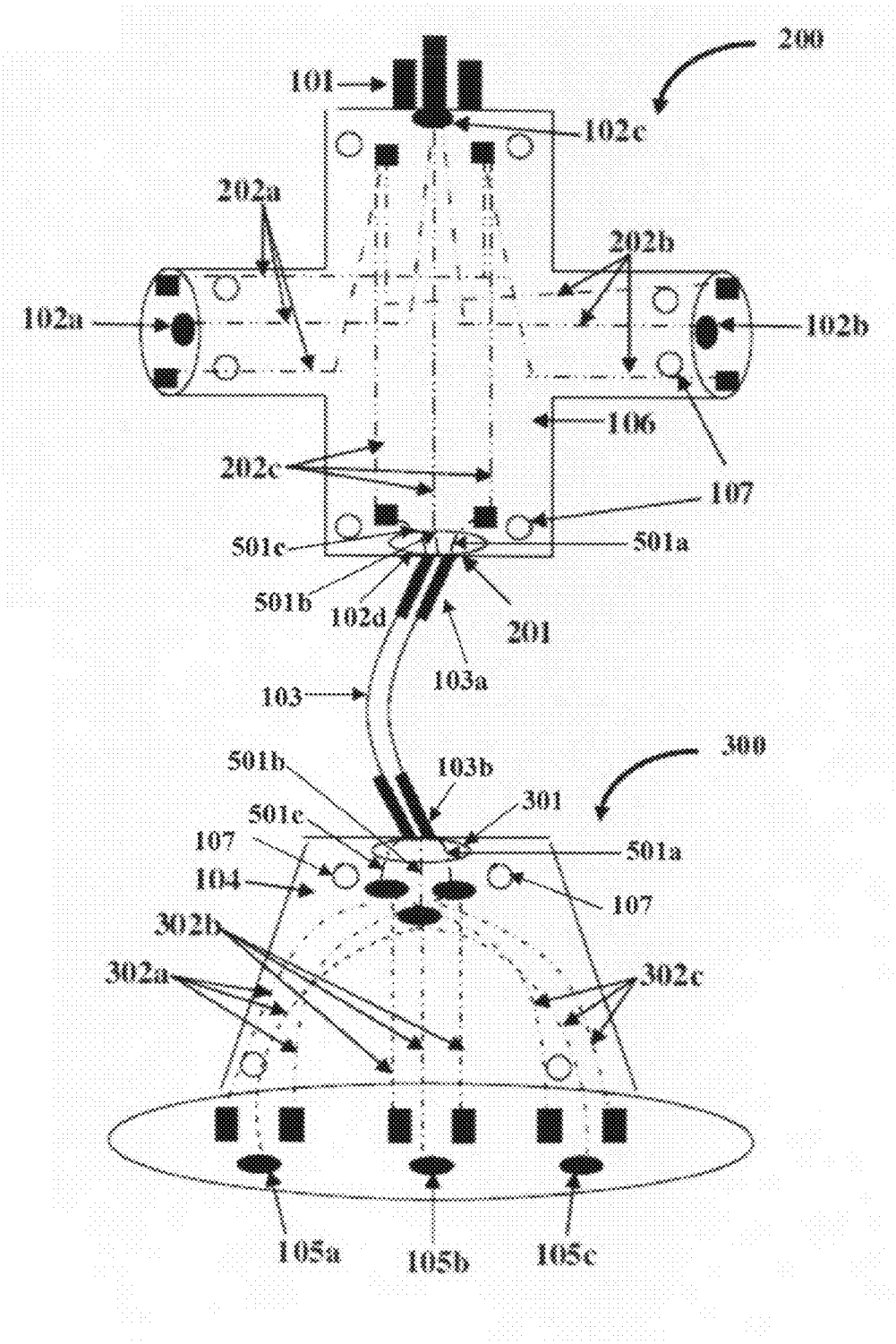
FIG. 5 exemplarily illustrates the electrical connection established between the mains plug and a power extender through multiple wires of the extension cable.

Instead of the extension cable 103, multiple wires 501*a*, 501*b*, and 501*c*, as illustrated in FIG. 5 may be used to connect the power extender 300 to the malfunctioning female power outlet 102*a*, 102*b*, 102*c*, or 102*d* of the mains plug 200 through the second wire inlet 301 and the first wire inlet 201 respectively. The multiple wires, therefore, enable replacement of the malfunctioning female power outlet 102*a*, 102*b*, 102*c*, or 102*d* with the power extender 300 comprising the second female power outlets 105*a*, 105*b*, and 105*c*. Two or more extension cables may be provided for providing two or more sets of second female power outlets 105*a*, 105*b*, and 105*c* to replace the malfunctioning female power outlet 102*a*, 102*b*, 102*c*, or 102*d*.

In an embodiment, the extension cable comprises the multiple wires 501*a*, 501*b*, and 501*c*, illustrated in FIG. 5. The multiple wires 501*a*, 501*b*, and 501*c* at the first end 103*a* of the extension cable 103 are connected to the first internal wires 202*a*, 202*b*, and 202*c* of the mains plug 200. The multiple wires 501*a*, 501*b*, and 501*c* at the second end 103*b* of the extension cable 103 are connected to the second internal wires 302*a*, 302*b*, and 302*c* of the power extender.

Figure 4:
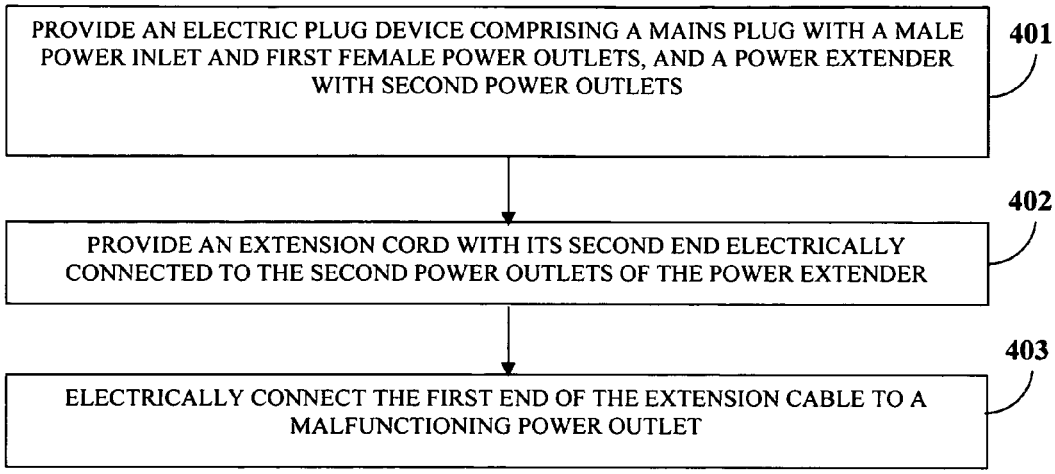
FIG. 4 illustrates a method of extending and replacing a malfunctioning female power outlet.

FIG. 4 illustrates a method of extending and replacing a malfunctioning female power outlet 102*a*, 102*b*, 102*c*, or 102*d*. An electric plug device 100 comprising a mains plug 200 and a power extender 300 is provided 401. The electric plug device 100 is illustrated in FIG. 1. The mains plug 200 comprises a male power inlet 101 and multiple first female power outlets 102*a*, 102*b*, 102*c*, and 102*d*. The male power inlet 101 provides an electrical input pathway. The male power inlet 101 is electrically connected to the first female power outlets 102*a*, 102*b*, 102*c*, and 102*d* within the first insulating case 106. The first female power outlets 102*a*, 102*b*, 102*c*, and 102*d* provide multiple electrical output pathways. The power extender 300 comprises multiple second female power outlets 105*a*, 105*b*, and 105*c* for providing multiple electrical output pathways. An extension cable 103 is provided 402. The extension cable 103 comprises a first end 103*a* and a second end 103*b*. The first end 103*a* of the extension cable 103 is electrically connected 403 to the malfunctioning female power outlet 102*a*, 102*b*, 102*c*, or 102*d* though a first wire inlet 201 of the mains plug 200. The first wire inlet 201 of the mains plug 200 is exemplarily illustrated in FIG. 2.

The second end 103*b* of the extension cable 103 is electrically connected to the second female power outlets 105*a*, 105*b*, and 105*c* of the power extender 300 through the second wire inlet 301 of the power extender 300. The second wire inlet 301 is exemplarily illustrated in FIG. 3. The electrical connection of the extension cable 103 enables flow of electric current from the malfunctioning female power outlet 102*a*, 102*b*, 102*c*, or 102*d* to the second female power outlets 105*a*, 105*b*, and 105*c*. For example, if the first female power outlet 102*b* malfunctions, the electric current drawn by the male power inlet 101 from the external power outlet will be transferred to the extension cable 103, the first end 103*a* of which is connected to the malfunctioning female power outlet 102*b*. The second end 103*b* of the extension cable 103 connects to the power extender 300 comprising the second female power outlets 105*a*, 105*b*, and 105*c*. The first end 103*a* of the extension cable 103 electrically connects to the malfunctioning female power outlet 102*b*, thereby replacing the malfunctioning first power outlet with the second female power outlets 105*a*, 105*b*, and 105*c*.

Consider an example of an electric plug device 100 with a malfunctioning female power outlet 102*d*. The mains plug 200 of the electric plug device 100 may be connected to an external power outlet via the male power inlet 101. Electric current is drawn from the external power outlet into the mains plug 200 through the male power inlet 101 of the mains plug 200. The electric current drawn is distributed from the male power inlet 101 to the first female power outlets 102*a*, 102*b*, and 102*d* via the first internal wires 202*a*, 202*b*, and 202*c* connected from the male power inlet 101 to the first female power outlets 102*a*, 102*b*, and 102*d*. An external device may be plugged into the first female power outlets 102*a*, 102*b*, and 102*c*. An external device connected to the malfunctioning female power outlet 102*d* will be unable to draw the electric current from the malfunctioning female power outlet 102*d*.

The first insulating case 106 of the mains plug 200 may be opened for identifying and replacing the malfunctioning female power outlet 102*d*. The first end 103*a* of the extension cable 103 is connected to the identified malfunctioning female power outlet 102*d* through the first wire inlet 201. The first internal wires 202*c* of the mains plug 200 from the male power inlet 101 now connect to the first end 103*a* of the extension cable 103 through the first wire inlet 201. The second end 103*b* of the extension cable 103 is connected to the power extender 300 comprising the second female power outlets 105*a*, 105*b*, and 105*c* through the second wire inlet 301. The first end 103*a* of the extension cable 103 is electrically connected to the second end 103*b* of the extension cable 103. Therefore, the electric current drawn by the male power inlet 101 is distributed to the second female power outlets 105*a*, 105*b*, and 105*c*. The electrically connected second female power outlets 105*a*, 105*b*, and 105*c* supply the electric current to external devices plugged into the second female power outlets 105*a*, 105*b*, and 105*c*.

In the example described above, the electric current from the male power inlet 101 flows through the first internal wires 202*c* to the first female power outlet 102*d*. When the first power outlet 102*d* malfunctions, the first end 103*a* of the extension cable 103 is connected to the malfunctioning female power outlet 102*d*. The extension cable 103 carries the electric current from the first end 103*a* connected to the malfunctioning female power outlet 102*d* to the second end 103*b* of the extension cable 103 connected to the power extender 300. The electric current from the second end 103*b* of the extension cable 103 is distributed to the second female power outlets 105*a*, 105*b*, and 105*c* through the second internal wires 302*a*, 302*b*, and 302*c* connected between the second end 103*b* of the extension cable 103 and the second female power outlets 105*a*, 105*b*, and 105*c*.

The foregoing examples have been provided merely for the purpose of explanation and are in no way to be construed as limiting of the present invention disclosed herein. While the invention has been described with reference to various embodiments, it is understood that the words, which have been used herein, are words of description and illustration, rather than words of limitation. Further, although the invention has been described herein with reference to particular means, materials and embodiments, the invention is not intended to be limited to the particulars disclosed herein; rather, the invention extends to all functionally equivalent structures, methods and uses, such as are within the scope of the appended claims. Those skilled in the art, having the benefit of the teachings of this specification, may effect numerous modifications thereto and changes may be made without departing from the scope and spirit of the invention in its aspects.

I claim:

1. An electric plug device for extending and replacing a malfunctioning female power outlet, comprising:

a mains plug comprising a male power inlet for providing an electrical input pathway, and a plurality of first female power outlets for providing a plurality of electrical output pathways, wherein the malfunctioning female power outlet is one of the first female power outlets, wherein each of said first female power outlets is replaceable with a first wire inlet configured to receive an extension cable and provide access to first internal contacts of said malfunctioning female power outlet, said first internal contacts disposed proximal to said first wire inlet, and wherein said male power inlet is electrically connected to said first female power outlets and said first internal contacts disposed proximal to said first wire inlet;

said extension cable comprising a first end and a second end, said first end of said extension cable configured to electrically connect to said first internal contacts disposed proximal to said first wire inlet, wherein said extension cable electrically connects said first internal contacts to a power extender; and said power extender comprising a plurality of second female power outlets for providing a plurality of electrical output pathways and a second wire inlet configured to receive said second end of said extension cable and provide access to second internal contacts disposed proximal to said second wire inlet, wherein the first internal contacts are connected to said second female power outlets by said extension cable and via said second internal contacts.

2. The electric plug device of claim 1, wherein said mains plug comprises a first insulating case in the shape of a cross having four corners for embedding the male power inlet and the first female power outlets, wherein said first wire inlet is positioned at one of said four corners of said first insulating case and said male power inlet and said first female power outlets are positioned at other of said four corners of said first insulating case.

3. The electric plug device of claim 2, wherein said first insulating case is provisioned for connecting the first end of the extension cable to the first internal contacts through said first wire inlet.

4. The electric plug device of claim 2, further comprising a plurality of screws for opening and closing said first insulting insulating case to connect the first end of the extension cable to the first internal contacts through said first wire inlet.

5. The electric plug device of claim 1, wherein the power extender comprises a second insulating case in the shape of a cone for embedding the second female power outlets, wherein said second wire inlet is positioned at an apex of said second insulating case and said second female power outlets are positioned at a base of said second insulating case.

6. The electric plug device of claim 5, wherein said second insulating case is provisioned for connecting the second end of the extension cable to the second female power outlets via said second internal contacts through said second wire inlet.

7. The electric plug device of claim 5, further comprising a plurality of screws for opening and closing said second insulating case to connect the second end of the extension cable to the second female power outlets through said second wire inlet and via said second internal contacts of the power extender.

8. An electric plug device for extending and replacing a malfunctioning female power outlet, comprising:

a male power inlet for providing an electrical input pathway, wherein said male power inlet is electrically connected to a plurality of first female power outlets, wherein said first female power outlets provide a plurality of electrical output pathways, wherein the malfunctioning female power outlet is one of the first female power outlets, and wherein each of said first female power outlets is replaceable with a first wire inlet configured to receive an extension cable and provide access to first internal contacts of said malfunctioning female power outlet, and wherein said first internal contacts are disposed proximal to said first wire inlet;

said extension cable comprising a first end and a second end, said first end of said extension cable configured to electrically connect to said first internal contacts disposed proximal to said first wire inlet, wherein said extension cable electrically connects said first internal contacts to a plurality of second female power outlets; and said second female power outlets for providing a plurality of electrical output pathways and a second wire inlet configured to receive said second end of said extension cable and provide access to second internal contacts disposed proximal to said second wire inlet, said second internal contacts electrically connected to said second female power outlets;

whereby said extension cable, the first wire inlet, the second wire inlet, and the second female power outlets enable said extension and said replacement of the malfunctioning female power outlet.

9. A method of extending and replacing a malfunctioning female power outlet, comprising the steps of:

providing an electric plug device comprising:

a mains plug comprising a male power inlet for providing an electrical input pathway, and a plurality of first female power outlets for providing a plurality of electrical output pathways, wherein each of said first female power outlets is replaceable with a first wire inlet configured to receive an extension cable and provide access to first internal contacts of said malfunctioning female power outlet, said first internal contacts disposed proximal to said first wire inlet, and wherein said male power inlet is electrically connected to said first female power outlets and said first internal contacts disposed proximal to said first wire inlet;

a power extender comprising a plurality of second female power outlets for providing a plurality of electrical output pathways and a second wire inlet configured to receive said extension cable and provide access to second internal contacts disposed proximal to said second wire inlet;

providing said extension cable comprising a first end and a second end;

replacing said malfunctioning female power outlet with said first wire inlet, wherein the malfunctioning female power outlet is one of the first female outlets of said mains plug;

electrically connecting said first end of the extension cable to said first internal contacts disposed proximal to said first wire inlet of said mains plug; and electrically connecting said second end of said extension cable to said second internal contacts disposed proximal to said second wire inlet, said second internal contacts electrically connected to said second female power outlets, whereby said second end of said extension cable is electrically connected to said second female power outlets of said power extender.

10. The method of claim 9, wherein the male power inlet and the first female power outlets of the mains plug are embedded in a first insulating case having the shape of a cross with four corners, wherein said first wire inlet is positioned at one of said four corners of said first insulating case, and said male power inlet and said first female power outlets are positioned at other of said four corners of said first insulating case.

11. The method of claim 10, wherein said first insulating case is provisioned for connecting the first end of the extension cable to the first internal contacts through said first wire inlet.

12. The method of claim 10, wherein the electric plug device further comprises a plurality of screws for opening and closing said first insulating case to connect the first end of the extension cable to the first internal contacts through said first wire inlet.

13. The method of claim 9, wherein the second female power outlets of the power extender are embedded in a second insulating case having the shape of a cone, wherein said second wire inlet is positioned at an apex of said second insulating case and said second female power outlets are positioned at a base of said second insulating case.

14. The method of claim 13, wherein said second insulating case is provisioned for connecting the second end of the extension cable to the second female power outlets through said second wire inlet and via said second internal contacts.

15. The method of claim 13, wherein the electric plug device further comprises a plurality of screws for opening and closing said second insulating case to connect the second end of the extension cable to the second female power outlets through said second wire inlet of said power extender.

16. The electric plug device of claim 1, wherein a voltage rating of said mains plug is increased by replacing said male power inlet and said first female power outlets of lower voltage rating with another male power inlet and female power outlets of higher voltage rating.

17. The electric plug device of claim 1, further comprising multiple third female power outlets laterally positioned on said mains plug and said power extender for providing additional electrical output pathways.

18. The electric plug device of claim 1, further comprising two or more extension cables connected to two or more power extenders for providing two or more sets of second female power outlets to replace said malfunctioning female power outlet.

19. An electric plug device for extending and replacing a malfunctioning female power outlet, comprising:

a mains plug comprising a male power inlet for providing an electrical input pathway, a plurality of first female power outlets for providing a plurality of electrical output pathways, wherein the malfunctioning female power outlet is one of the first female power outlets, and a first wire inlet configured to receive an extension cable and provide access to first internal contacts disposed proximal to said first wire inlet, wherein said male power inlet is electrically connected to said first female power outlets and said first internal contacts disposed proximal to said first wire inlet;

said extension cable comprising a first end and a second end, said first end of said extension cable configured to electrically connect to said first internal contacts disposed proximal to said first wire inlet, said extension cable electrically connecting said first internal contacts to a power extender; and said power extender comprising a plurality of second female power outlets for providing a plurality of electrical output pathways and a second wire inlet configured to receive said second end of said extension cable and provide access to second internal contacts disposed proximal to said second wire inlet, wherein the first internal contacts are connected to said second female power outlets by said extension cable and via said second internal contacts.

* * * * *